United States Patent [19]

Williams

[11] Patent Number: 5,002,233

[45] Date of Patent: Mar. 26, 1991

[54] REVERSIBLE HAMMERS FOR HAMMER MILLS

[76] Inventor: Robert M. Williams, 16 La Hacienda, Ladue, Mo. 63124

[21] Appl. No.: 462,077

[22] Filed: Jan. 8, 1990

[51] Int. Cl.[5] ..... B02C 13/04

[52] U.S. Cl. ..... 241/189 A; 241/194; 241/195

[58] Field of Search ..... 241/189 R, 194, 195, 241/191, 300, 189 A

[56] References Cited

U.S. PATENT DOCUMENTS

| | | | |
|---|---|---|---|
| 1,301,316 | 4/1919 | Plaisted | 241/194 |
| 1,821,482 | 9/1931 | Schutte | 241/194 |
| 1,954,175 | 4/1934 | Jensen | 241/195 |
| 2,471,068 | 5/1949 | Keiper | 241/189 A X |
| 2,822,138 | 2/1958 | Olive | 241/194 |

FOREIGN PATENT DOCUMENTS

| | | | |
|---|---|---|---|
| 2594356 | 8/1987 | France | 241/194 |

*Primary Examiner*—Mark Rosenbaum

*Attorney, Agent, or Firm*—Gravely, Lieder & Woodruff

[57] ABSTRACT

A material grinding mill of reversible character having hog-type hammers formed with chisel edges pivotally mounted on supporting discs, and further formed with landing areas positioned to contact the supporting discs so that the chisel edges are prevented from impacting upon or nicking the discs. The pivoting of the hammers allows them to rebound when encountering a body of hardened material so the hammer reverses direction, hence the landing area impacts on the discs and the discs are protected against being nicked by the chisel edges of the hammers.

1 Claim, 1 Drawing Sheet

FIG. 1.
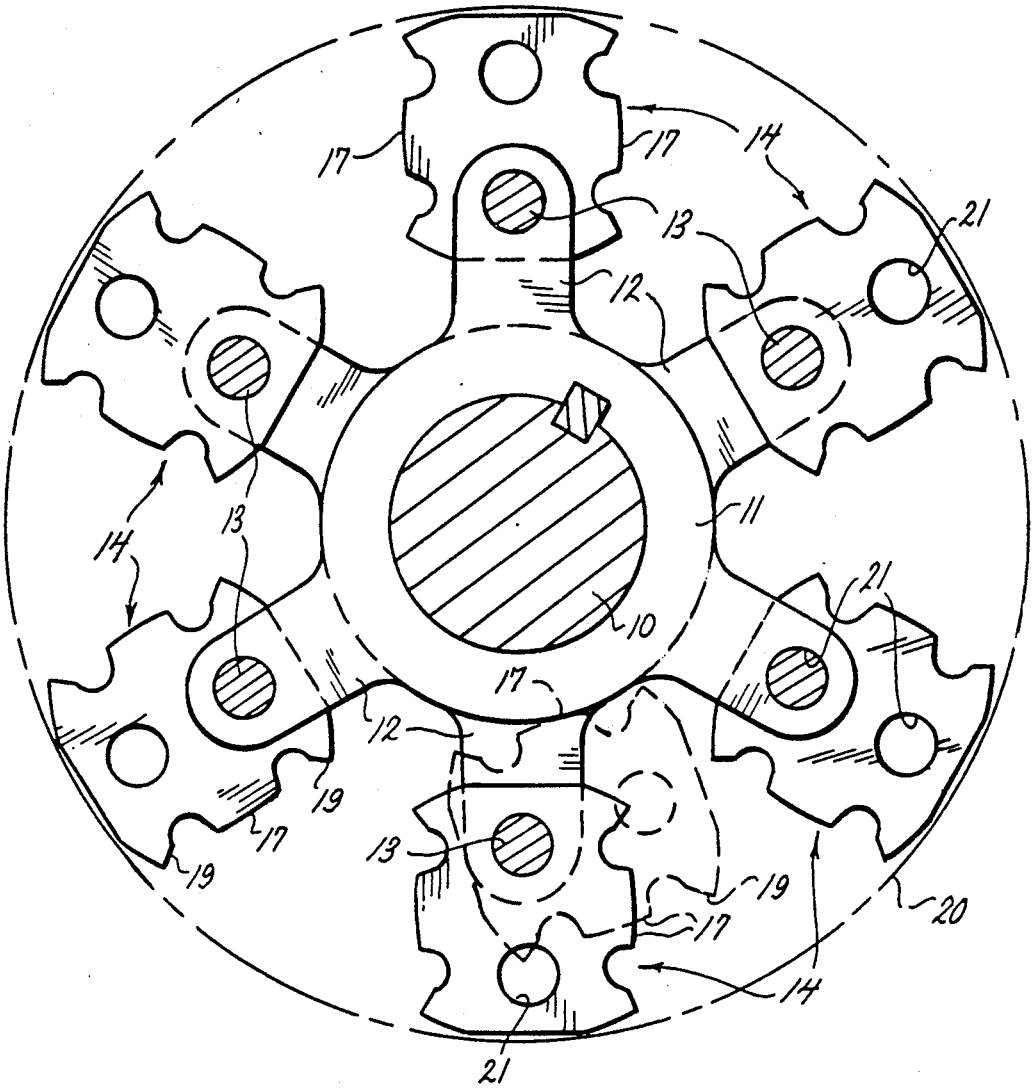
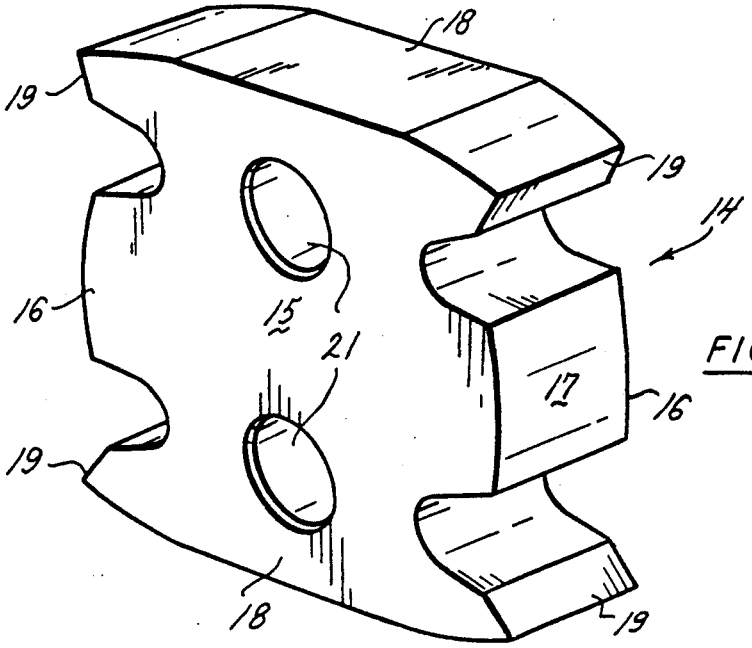
FIG. 2.

REVERSIBLE HAMMERS FOR HAMMER MILLS

BACKGROUND OF THE INVENTION

1. Field of the Invention

This invention relates to an improved two-way hammer for rotary mills of reversible character.

2. Description of the Prior Art

In reversible hammer mills having pivoted hammers, the hammers must be able to pivot or swing in either direction. The response of the hammers can be rapid where a particularly hard object is encountered, and the response causes the hammer to swing in a direction reverse to the direction of rotation of the hammer carrying discs. When the hammers are formed with sharp edges they are known in the art as hog-type hammers. It is this type of hammer that has caused trouble when any hammer is caused to rebound from a hard object. That rebound causes the sharp edge to notch or nick the supporting disc. That notch or nick develops ultimate failure of the disc by cracking.

The discs are difficult to see, and failure of the mill usually occurs at an unexpected time, and the damage to the mill or the cracked rotor discs can be costly.

SUMMARY OF THE INVENTION

A principal object of the invention is to permit the continued use of hog-type pivoted hammers in reversible hammer mills, while preventing the occurrence of nicks in the hammer carrying rotors.

The continued availability of hog hammer mills is important and to allow the continuing use of such mills of the reversible type, it has been determined that the sharp or chiselled edge of the hammers must be prevented from impacting on or nicking the supporting disc when caused to rebound.

Therefore, it is an important object of the invention to provide hog-type hammers with a landing area adjacent the sharp edges in position to prevent the sharp edges contacting any part of the discs on which they are mounted, and to form such a landing area that will be effective with double ended and reversible hammers.

BRIEF DESCRIPTION OF THE DRAWINGS

The improved two-way double ended hammers are seen in FIG. 1 of the drawing view which is a vertical section view through the drive shaft of a reversible mill hammer rotor showing the hammers of this invention; and FIG. 2 is a perspective view of a reversible-type double-ended hammer.

DETAILED DESCRIPTION OF THE INVENTION

For purposes of clarity of understanding the environment of the present invention, there is shown in U.S. Pat. No. 4,767,066 a reversible hammer mill having pivotally mounted hammers in a rotor assembly on the drive shaft.

In FIG. 1 the drive shaft 10 carries discs 11 which have radially directed arms 12 to receive pivot pins 13 which secure the hog double ended hammers 14 in pivotal positions at the ends of the arms 12. It is seen in FIG. 1 that a first disc 11 has three radially directed arms 12 spaced at 120°, and there is a second disc behind the first disc also with three arms 12 at 120° of spacing, with the result that the complement of arms assume angular spacing of 60° such that portions of the discs are exposed. Each hog-type double-ended hammer has a body 15 formed on opposite sides of the central body area with projecting portions 16 having substantially flat faces 17. The outer end portion 18 of the hammer body 15 is formed to provide sharp knife-like edges 19. The hammer ends 18 define the path of the rotor circle 20.

Each hammer body 15 (see FIG. 2) is formed with two bores 21 so that either bore 21 may be employed to receive the pivot at pin 13. Thus, the hammers may be used in either position, since each hammer body 15 has opposite centrally located and outwardly facing landing areas 16. The landing areas 16 are located so that when a hammer rebounds in either direction and opposite to the direction of rotation of the rotor assembly the sharp edges 19 are held away from the disc 11 to prevent nicking the disc. Thus, the importance of the respective landing area faces 17 is easily appreciated.

In the field of reversible hammer mills the type of material to be ground is composed of chunks of material, whether coal, rocks or other material, which must be impacted by hammers that can be rotated at speeds necessary to develop the momentum at impact that breaks up the material. The present double-ended and double edge hammer bodies are formed of hardened material having weight of the order of more than one hundred pounds. This weight when travelling at rotating speeds of 1200 RPM develop an impact force that is sufficient for normal breaking of the material. However, when the material is a body of hardened character and mass equal to or greater than the hammers, the reaction is one where the hammer is forced to rebound in order to allow the rotor to continue rotation. The rebound reaction is rapid and the weight of the hammer or hammers can develop a significant impact. Therefore, the hammer configuration of this invention is formed with a pad having an area that is large enough to accomplish the need to keep the hammer edges 19 free of contact with the supporting disc means.

The foregoing disclosure is not intended to unnecessarily limit the scope of the invention or its field of use.

What is claimed is:

1. In a reversible hammer mill the improvement comprising:

a. a rotor assembly having discs each formed with radially projecting arms angularly spaced apart at distances such that said arms are substantially symmetrically spaced apart around the circumference of said rotor discs and expose a portion of said discs between said projecting arms;

b. a drive shaft supporting said rotor assembly;

c. hammer means for connection to each of said arms, each hammer means having an elongated body formed with a central body pad area and opposite end portions presenting oppositely facing substantially flap landing face areas aligned in the direction of traveling during rotation of said rotor discs, said opposite end portions of said hammer means being in the same direction of travel thereby presenting impact edges in the same direction of travel of the rotor assembly; and d. pivot means connecting each of said hammer means to a respective arm such that each of said landing face areas is positioned to swing about said pivot pin and impact by one of said flat landing face areas on an exposed disc while supporting an impact edge spaced from said exposed portion of each portion.

* * * * *